US005659331A

United States Patent [19]

Oh et al.

[11] Patent Number: 5,659,331

[45] Date of Patent: Aug. 19, 1997

[54] APPARATUS AND METHOD FOR DRIVING MULTI-LEVEL GRAY SCALE DISPLAY OF LIQUID CRYSTAL DISPLAY DEVICE

[75] Inventors: Choon-yul Oh; Sun-jeong Choi, both of Suwon, Rep. of Korea

[73] Assignee: Samsung Display Devices Co., Ltd., Kyungki-do, Rep. of Korea

[21] Appl. No.: 400,759

[22] Filed: Mar. 8, 1995

[51] Int. Cl.[6] ..... G09G 3/36

[52] U.S. Cl. ..... 345/95; 345/89

[58] Field of Search ..... 345/87, 89, 92, 345/95, 97, 50, 52, 51, 147; 359/54, 56, 59; 349/33, 41, 42

[56] References Cited

U.S. PATENT DOCUMENTS

| | | | |
|---|---|---|---|
| 3,668,639 | 6/1972 | Harmuth . | |
| 4,775,891 | 10/1988 | Aoki et al. | 345/87 |
| 5,200,741 | 4/1993 | Usui | 345/95 |
| 5,459,495 | 10/1995 | Scheffer et al. | 345/89 |

FOREIGN PATENT DOCUMENTS 0391655 10/1990 European Pat. Off. .

*Primary Examiner*—Chanh Nguyen

*Attorney, Agent, or Firm*—Leydig, Voit & Mayer

[57] ABSTRACT

An apparatus and method for driving a multi-level gray scale display are provided. The apparatus displays multi-level gray scale without an analog driving IC and includes a row function generator for generating a row function, a column signal operator for receiving and operating the row function and display data to output a column data, a standard voltage selection signal generator for receiving a clock to generate a standard voltage selection signal, a column signal generator for generating a plurality of levels of column standard voltages and dividing the column standard voltage selected according to the standard voltage selection signal to generate a plurality of levels of column voltage so as to drive the column electrode according to the column data, and a row signal generator for generating a plurality of row standard voltages and dividing the row standard voltage selected according to the standard voltage selection signal to generate a plurality of levels of row voltage so as to drive the row electrode according to the row function.

3 Claims, 3 Drawing Sheets

APPARATUS AND METHOD FOR DRIVING MULTI-LEVEL GRAY SCALE DISPLAY OF LIQUID CRYSTAL DISPLAY DEVICE

BACKGROUND OF THE INVENTION

The present invention relates to an apparatus and method for the gray scale display of a liquid crystal display device, and more particularly, to an apparatus and method for multi-level gray scale display which provides a cost reduction effect by using an amplitude modulation method without an analog driving integrated circuit.

Well-known addressing methods used in liquid crystal display devices include the APT, IAPT, BAT, HAT, IHAT, AAT and SAT methods, and methods for displaying the gray scale include FRC, PWM, PHM, AM and dithering. Among these conventional gray-scale display methods, the frame conversion (FRC) method generates flicker in fast response LCDs. In the case of the amplitude modulation (AM) method or pulse height modulation (PHM) method which is used in the active addressing technique (AAT), there is a problem of a remarkable increase in the number of voltage levels applied at column electrodes as the number of levels of gray scale is increased. Since it is difficult for the voltage level to be exactly controlled due to the increased of number of voltage levels, an analog driving integrated circuit (IC) has generally been used.

FIG. 1 is a schematic diagram showing the construction of a conventional analog driving IC. The analog driving IC shown in FIG. 1 comprises a sampling pulse generator 70, a sampling holder 80, and an output buffer 90. Sampling pulse generator 70 comprises a logic circuit 72 for receiving a control signal via terminal 100 and a shift clock signal to generate the sampling pulse and a level converter 74 for level-converting the output of logic circuit 72, thereby generating a plurality of sampling pulses. In sampling holder 80, the video signal is input to an analog switching portion 82 via terminal 101, is switched according to the sampling pulse and temporarily stacked in a sampling condenser CSPL. The accumulated signal is output according to an output enable signal input to an analog switching portion 86 via terminal 107, is held by a hold condenser CH and is output to the column electrodes of the liquid crystal panel via output buffer 90.

If the analog driving IC as described above is used in the case of many gray scale displays, the cost of it is largely due to the high level of the column voltage, thereby raising the cost for manufacturing.

SUMMARY OF THE INVENTION

To solve the above problem, it is an object of the present invention to provide an apparatus and method for displaying the multi-level gray scale of an STN LCD without using the analog driving IC having high column voltage level, to thereby lower the manufacturing cost thereof.

To achieve the above object, the apparatus for driving a multi-level gray scale display of the liquid crystal display device according to the present invention comprises: a row function generator for generating a predetermined row function; column signal operating means for receiving and operating the row function and display data, to output column data; a standard voltage selection signal generator for receiving a clock to generate a standard voltage selection signal; a column signal generator for generating a plurality of levels of column standard voltages and dividing a column standard voltage selected according to the standard voltage selection signal to generate a plurality of levels of column voltage, so as to drive a column electrode according to the column data; and a row signal generator for generating a plurality of row standard voltages and dividing a row standard voltage selected according to the standard voltage selection signal to generate a plurality of levels of row voltage, so as to drive a row electrode according to the row function.

To achieve the above object, there is provided the method for driving a multi-level gray scale display of the liquid crystal display device according to the present invention, wherein the method comprises the steps of forming the levels of row and column voltages corresponding to each bit of applied image display data.

The step of forming the column voltage level according to the present invention comprises the steps of: selecting a standard voltage among the voltage levels generated from the column standard voltage generator in the column analog multiplexer using a selection signal generated from the standard voltage selection signal generator; dividing the column voltage level having a predetermined number according to the selected standard voltage level; and driving the column electrodes of liquid crystal panel in the liquid crystal panel driver according to the divided column voltage level.

The step of forming the row voltage level according to the present invention comprises the steps of: selecting a standard voltage among the voltage levels generated from the row standard voltage generator in the row analog multiplexer using a selection signal generated from the standard voltage selection signal generator; dividing the row voltage level having a predetermined number according to the selected standard voltage level; and driving the row electrodes of liquid crystal panel in the liquid crystal panel driver according to the divided row voltage level.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
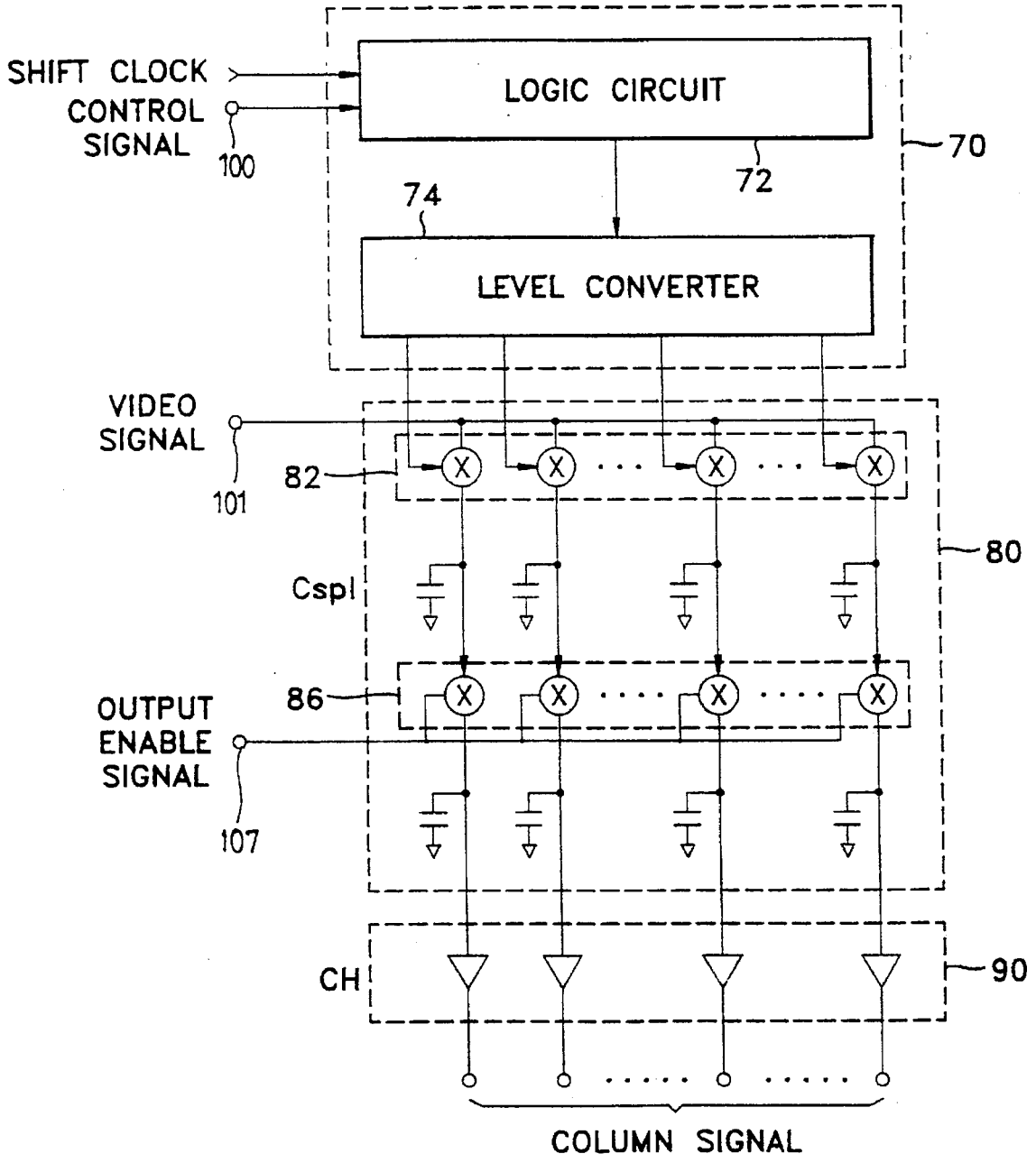
FIG. 1(PRIOR ART)
FIG. 1 is a schematic diagram showing the construction of a conventional analog driving IC.
Figure 2:
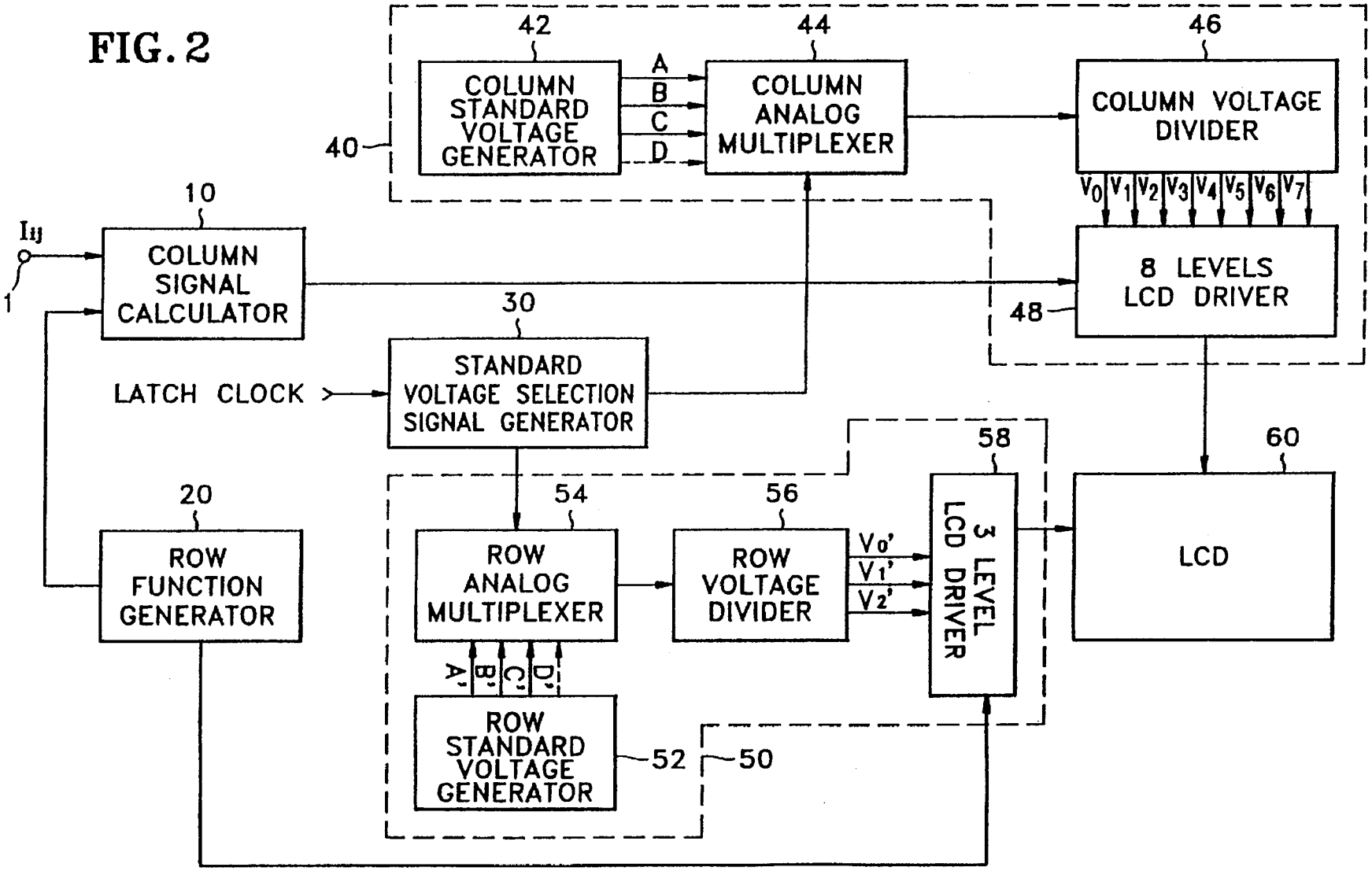
FIG. 2 is a block diagram showing a multi-level gray scale display driving apparatus according to the present invention.

FIG. 2 is a block diagram showing a multi-level gray scale display driving apparatus of an STN LCD according to the present invention. Here, the multi-level gray scale display driving apparatus of an STN LCD comprises a column signal calculator 10, a row function generator 20, a standard voltage selection signal generator 30, a column signal generator 40 and a row signal generator 50 to drive the multi-level gray scale of a liquid crystal panel 60. Column signal generator 40 comprises a column standard voltage generator 42, a column analog multiplexer 44, a column voltage divider 46 and an eight-level LCD driver 48. Row signal generator 50 comprises a row standard voltage generator 52, a row analog multiplexer 54, a row voltage divider 56 and a three-level LCD driver 58.

In an active addressing method for simultaneously driving L lines (rows), supposing that a row function is $F_i(t)$ and a column function is $G_j(t)$, an absolute value F of the voltage of row function $F_i(t)$ is expressed as following equation (1) and a maximum value G of column function $G_j(t)$ is expressed as following equation (2):

$$F = V_{th}\sqrt{\frac{N}{l}}\sqrt{\frac{\sqrt{N}}{2(\sqrt{N}-1)}} \quad (1)$$

$$G = \frac{Fl}{\sqrt{N}} \quad (2)$$

where $V_{th}$ is a threshold voltage of liquid crystal and N is total number of row lines.

On the other hand, suppose that the row functions for displaying an eight-gray scale and driving an L line at the same time are indicated as $F_{1i}(t)$, $F_{2i}(t)$ and $F_{3i}(t)$, and the column functions are indicated as $G_{1j}(t)$, $G_{2j}(t)$ and $G_{3j}(t)$, where i is 1, 2, 3, . . . , L and j is 1, 2, 3, . . . , M in an N×M pixel matrix. Here, the row function is an orthogonal function for driving L line at the same time. Suppose that the absolute values of voltages of row functions $F_{1i}(t)$, $F_{2i}(t)$ and $F_{3i}(t)$ are $F_1$, $F_2$ and $F_3$, respectively, the maximum values of voltages of column functions $G_{1j}(t)$, $G_{2j}(t)$ and $G_{3j}(t)$ are $G_1$, $G_2$ and $G_3$, and the display information data for displaying the gray scale are $I_{1ij}$, $I_{2ij}$ and $I_{3ij}$. Display data $I_{1ij}$, $I_{2ij}$ and $I_{3ij}$ for displaying the gray scale have a value of either +1 or −1. Also, if a ratio of voltages of row functions $F_1(t)$, $F_{2i}(t)$ and $F_{3i}(t)$ is 1:√2:2, column functions $G_{1j}(t)$, $G_{2j}/(t)$ and $G_{3j}(t)$ are expressed as the following equations.

$$G_{1j}(t) = \frac{1}{\sqrt{N}}\sum_{i=1}^{l} I_{1ij}F_{1i}(t) \quad (3)$$

$$G_{2j}(t) = \frac{1}{\sqrt{N}}\sum_{i=1}^{l} I_{2ij}F_{2i}(t) \quad (4)$$

$$G_{3j}(t) = \frac{1}{\sqrt{N}}\sum_{i=1}^{l} I_{3ij}F_{3i}(t) \quad (5)$$

Suppose that the voltage applied when a voluntary pixel $P_{ij}$ of N×M pixels is "on" is $V_{onRMS}$ and the voltage applied when a voluntary pixel $P_{ij}$ is "off" is $V_{offRMS}$, the values of $V_{onRMS}$ and $V_{offRMS}$ are obtained by the following equations (6) and (7), which satisfy a maximum selection ratio.

$$V_{onRMS} = \sqrt{F_1^2+F_2^2+F_3^2}\sqrt{\frac{2l}{3N}}\sqrt{\frac{\sqrt{N}+1}{\sqrt{N}}} \quad (6)$$

$$V_{offRMS} = \sqrt{F_1^2+F_2^2+F_3^2}\sqrt{\frac{2l}{3N}}\sqrt{\frac{\sqrt{N}-1}{\sqrt{N}}} \quad (7)$$

Here, if $V_{offRMs}$ is set as threshold voltage $V_{th}$ of liquid crystal, $F_1$, $F_2$ and $F_3$ are obtained from the following equation (8) and $G_1$, $G_2$ and $G_3$ can be obtained from equation (2) above.

$$F_1^2+F_2^2+F_3^2 = V_{th}^2\left(\frac{3N}{2l}\right)\left(\frac{\sqrt{N}}{\sqrt{N}-1}\right) \quad (8)$$

According to the conventional method, when the LCD is driven as the above-described method, the number of row voltage levels is seven and a multi-level driving IC having eight levels can be generally used. However, since the number of column voltage levels is twenty-four, an analog driving IC has to be used.

Meanwhile, according to the present invention, a plurality of standard voltages A, B, C, D, A', B', C'and D' are generated from standard voltage generators 42 and 52, and are input to analog multiplexers 44 and 54. Analog multiplexers 44 and 54 select one of the standard voltages input according to the standard voltage selection signal, and outputs a plurality of voltage levels via voltage dividers 46 and 56. The plurality of voltage levels output via voltage dividers 46 and 56 are obtained as row and column voltages using multi-level driving ICs 48 and 58. That is, after three standard voltages are generated, analog multiplexer 44 selects a specific standard voltage and outputs the selected voltage to voltage divider 46. Then, voltage divider 46 generates the column voltage of total 24 levels (3×8=24) when each voltage of eight levels with response to the selected standard voltage is generated. Also, after three standard voltages are generated, analog multiplexer 54 selects a specific standard voltage and outputs the selected voltage to voltage divider 56. Then, voltage divider 56 generates the row voltage having a total of seven levels (3×2+1=7) when each voltage of three levels with response to the selected standard voltage is generated.

In FIG. 2, the display data is input to a column signal calculator 10 via a terminal 1 and a row function generator 20 generates a row function based on a Walsh function installed in the ROM, to be output to three-level driver 58 and column signal calculator 10. Column signal calculator 10 generates column data from the display data and row function, to be output to an eight-level LCD driver 48. Row standard voltage generator 52 generates three fixed standard voltages A' ($F_1$), B' ($F_2$) and C' ($F_3$) calculated by equation (8), to be output to row analog multiplexer 54. Row analog multiplexer 54 receives a selection signal from a standard voltage selection signal generator 30, selects one of the three row standard voltages and outputs the selected voltage to row voltage divider 56. Row voltage divider 56 divides the selected standard voltage and outputs three voltage levels to three-level LCD driver 58. Here, since $V_1'$ of the three voltage levels is fixed as a standard electric potential, row voltage levels which can be generated by three standard voltages are seven (3×2+1). Three-level LCD driver 58 drives the row electrode of LCD 60 according to the row function. Column standard voltage generator 42 generates fixed standard voltages A ($G_1$), B ($G_2$) and C ($G_3$) calculated by equation (2) and outputs the generated voltages to a column analog multiplexer 44. Column analog multiplexer 44 receives a selection signal from standard voltage selection signal generator 30, selects one of three column standard voltages and outputs the selected voltage to column voltage divider 46. Column voltage divider 46 divides the selected column standard voltage into eight voltage levels and outputs the divided voltage levels to eight-level LCD driver 48. Eight-level LCD driver 48 drives the column electrode of LCD 60 according to the column data. Standard voltage selection signal generator 30 receives and counts a latch clock, to generate the standard voltage selection signal for selecting row and column standard voltages. Thus, the row voltage and the column voltage can have levels of seven and twenty-four, respectively, so as to display eight gray scales.

On the other hand, we suppose that the row functions are expressed as $F_{1i}(t)$, $F_{2i}(t)$, $F_{3i}(t)$ and $F_{4i}(t)$ and the column functions are expressed as $G_{1j}(t)$, $G_{2j}(t)$, $G_{3j}(t)$ and $G_{4j}(t)$, so as to display sixteen gray scales. The absolute values of voltage of row functions $F_{1i}(t)$, $F_{2i}(t)$, $F_{3i}(t)$ and $F_{4i}(t)$ are expressed as $F_1$, $F_2$, $F_3$ and $F_4$, and the maximum values of voltages of column functions $G_{1j}(t)$, $G_{2j}(t)$, $G_{3j}(t)$ and $G_{4j}(t)$ are expressed as $G_1$, $G_2$, $G_3$ and $G_4$. Also, the display information data for displaying the gray scale are expressed as $I_{1ij}$, $I_{2ij}$, $I_{3ij}$ and $I_{4ij}$. These display data values $I_{1ij}$, $I_{2ij}$, $I_{3ij}$ and $I_{4ij}$ having gray scale information each have one value either +1 or −1. Also, if a ratio of voltages of $F_{1i}(t)$, $F_{2i}(t)$, $F_{3i}(t)$ and $F_{4i}(t)$ is set as $1:\sqrt{2}:2:2\sqrt{2}$, $G_{1j}(t)$, $G_{2j}(t)$ and $G_{3j}(t)$ are expressed as equations (3) to (5) and $G_{4j}(t)$ is expressed as the following equation (9).

$$G_{4j}(t)=\frac{1}{\sqrt{N}}\sum_{i=1}^{I} I_{4ij}F_{4i}(t) \tag{9}$$

Therefore, according to FIG. 2, when row standard voltage generator 52 generates four standard voltages A' ($F_1$), B' ($F_2$), C' ($F_3$) and D' ($F_4$) and divides these standard voltages, nine levels of row voltage are obtained. Also, when column standard voltage generator 42 generates four standard voltages A ($G_1$), B ($G_2$), C ($G_3$s) and D ($G_4$) and divides these standard voltages into eight levels, the column voltage of thirty-two levels can be obtained.

As described above, in the method for obtaining the row voltage, the ratio of row voltages from first row voltage $F_1$, second row voltage $F_2$, third row voltage $F_3$, fourth row voltage $F_4$, . . . , to nth row voltage $F_n$ has to be within 30% of $1:\sqrt{2}:2:2\sqrt{2}:\ldots:\sqrt{2}^{n-1}$.

Figure 3A:
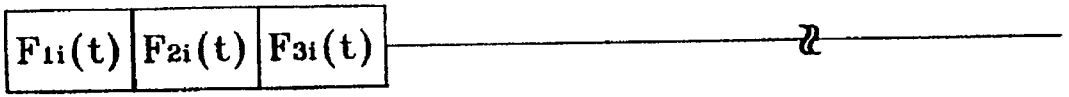
FIGS. 3A–3C are examples of a row waveform according to the present invention.
Figure 3B:
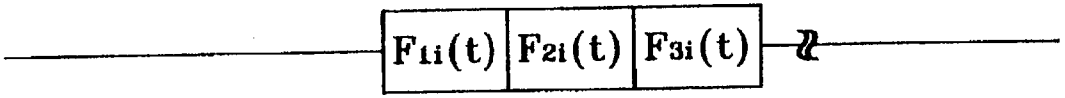
Figure 3C:
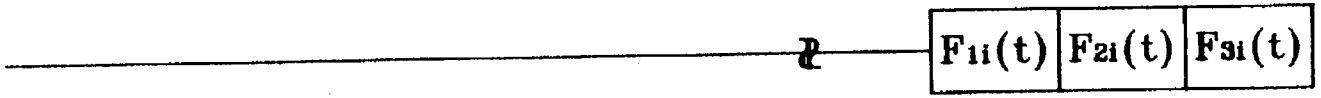
Figure 4A:
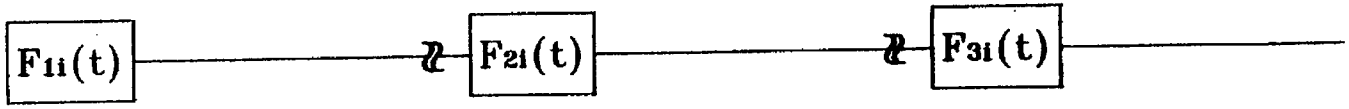
FIGS. 4A–4C are other examples of a row waveform according to the present invention.
Figure 4B:
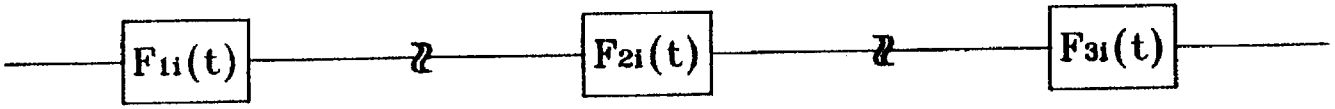
Figure 4C:
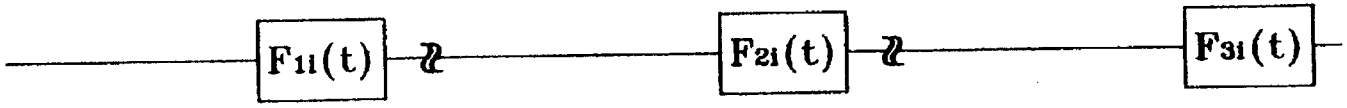

FIGS. 3A–3C are schematic diagrams showing examples of a row waveform for obtaining eight gray scales. Here, row functions $F_{1i}(t)$, $F_2(t)$ and $F_{3i}(t)$ are continuously applied. FIGS. 4A–4C are schematic diagrams showing other examples of a row waveform. In FIGS. 4A–4C, first, $F_i(t)$ of row functions $F_{1i}(t)$, $F_{2i}(t)$ and $F_{3i}(t)$ is applied from the first row electrode in sequence. Then, after $F_{1i}(t)$ returns to the first row electrode, $F_{2i}(t)$ is applied to whole row electrode in sequence. Thereafter, $F_{3i}(t)$ is applied to whole row electrode from the first row electrode in sequence.

As described above, the multi-level driving IC is simply used, not the analog driving IC having a plurality of voltage levels, so as to display eight or sixteen gray scales, thereby reducing cost, without flicker and an RC filtering phenomenon compared with a frame modulation method or pulse amplitude modulation method.

What is claimed is:

1. An apparatus for driving a multi-level gray scale display of a liquid crystal display device comprising:

a row function generator for generating a predetermined row function;

column signal operating means for receiving and operating said row function and display data, to output column data;

a standard voltage selection signal generator for receiving a clock signal and generating a standard voltage selection signal;

a column signal generator including a column standard voltage generator for generating a plurality of column standard voltages, a column analog multiplexer for selecting one of the plurality of column standard voltages responsive to the standard voltage selection signal, a column voltage divider for receiving the selected column standard voltage and dividing the selected column standard voltage into a plurality of levels and a multi-level driver for receiving the output of the column voltage divider, said column signal generator driving a column electrode of the liquid crystal display device; and a row signal generator including a row standard voltage generator for generating a plurality of row standard voltages, a row analog multiplexer for selecting one of the plurality of row standard voltages responsive to the standard voltage selection signal, a row voltage divider for receiving the selected row standard voltage and dividing the selected row standard voltage into a plurality of levels, and a multi-level driver for receiving the output of the row voltage divider, said row signal generator driving a row electrode of the liquid crystal display device.

2. An apparatus for driving a multi-level gray scale display of a liquid crystal display device as claimed in claim 1, wherein a ratio of each level of the plurality of levels of the selected row voltage to a consecutive level of the plurality of levels of the selected row voltage is within 30% of $1:\sqrt{2}$.

3. An apparatus for driving a multi-level gray scale display of a liquid crystal display device as claimed in claim 1 wherein a ratio of each level of the plurality of levels of the selected row standard voltage to a consecutive level of the plurality of levels of the selected row standard voltage is about $1:\sqrt{2}$.

* * * * *